US010028597B2

(12) United States Patent
Bacallao

(10) Patent No.: US 10,028,597 B2
(45) Date of Patent: Jul. 24, 2018

(54) BAGGING STATION SUPPORT FRAME AND METHOD OF FORMING THE SAME

(71) Applicant: Wal-Mart Stores, Inc., Bentonville, AR (US)

(72) Inventor: Yurgis Mauro Bacallao, Centerton, AR (US)

(73) Assignee: WALMART APOLLO, LLC, Bentonville, AR (US)

( * ) Notice: Subject to any disclaimer, the term of this patent is extended or adjusted under 35 U.S.C. 154(b) by 0 days.

(21) Appl. No.: 15/666,942

(22) Filed: Aug. 2, 2017

(65) Prior Publication Data

US 2017/0325603 A1 Nov. 16, 2017

Related U.S. Application Data

(63) Continuation-in-part of application No. 15/381,552, filed on Dec. 16, 2016, now Pat. No. 9,844,283.

(60) Provisional application No. 62/375,691, filed on Aug. 16, 2016, provisional application No. 62/270,881, filed on Dec. 22, 2015.

(51) Int. Cl.
*A47F 9/04* (2006.01)
*B65B 67/12* (2006.01)

(52) U.S. Cl.
CPC ..... *A47F 9/042* (2013.01); *B65B 67/1227* (2013.01); *B65B 67/1233* (2013.01); *B65B 67/1266* (2013.01); *B65B 2067/1294* (2013.01)

(58) Field of Classification Search
CPC combination set(s) only.
See application file for complete search history.

(56) References Cited

U.S. PATENT DOCUMENTS 911,568 A 2/1909 Bickford
1,357,280 A 11/1920 Dulle
2,270,796 A 1/1942 Hauser
(Continued)

FOREIGN PATENT DOCUMENTS

CN 102358484 A 2/2012
CN 102747813 B 12/2014
(Continued)

OTHER PUBLICATIONS

"POS Check Out Plastic Bag Holder Dispenser For Retail Supermarket Brand New!" Ebay.com, accessed on Nov. 17, 2016; 5 pages.

(Continued)

*Primary Examiner* — Alfred Wujciak
(74) *Attorney, Agent, or Firm* — Schmeiser, Olsen & Watts LLP

(57) ABSTRACT

Disclosed herein is a bagging station support frame that includes a top assembly and a bottom assembly. The top assembly holds a bagging station. A bagging station holds a plurality of shopping bags ready to receive products. The top assembly includes a back structure that couples to the bagging station, and a rail coupler. The rail coupler couples the top assembly to a first rail. The bottom assembly is coupled to the top assembly, and includes a first and a second foot. The first and the second foot couple to a second rail. The bagging station support frame can be coupled to rails anywhere in a retail store. A bagging station coupled to the bagging station support frame will be available for customers to bag their purchases wherever the bagging station support frame with bagging station is mounted.

7 Claims, 9 Drawing Sheets

(56) References Cited

U.S. PATENT DOCUMENTS

| | | | |
|---|---|---|---|
| 2,920,854 | A | 1/1960 | Morse, Jr. |
| 2,925,916 | A | 2/1960 | Pollock |
| 4,005,801 | A | 2/1977 | Musser |
| 4,199,122 | A | 4/1980 | Christie |
| 4,305,558 | A | 12/1981 | Baker |
| 4,949,924 | A | 8/1990 | Carmody |
| 4,998,694 | A | 3/1991 | Barteaux |
| 5,152,404 | A | 10/1992 | Salrin et al. |
| 5,170,719 | A | 12/1992 | Pestone |
| 5,395,080 | A | 3/1995 | Smith |
| 5,437,346 | A | 8/1995 | Dumont |
| 5,439,120 | A | 8/1995 | Brozak |
| 5,465,846 | A | 11/1995 | Blyth et al. |
| 5,485,932 | A | 1/1996 | Romm et al. |
| 5,695,073 | A | 12/1997 | Klein et al. |
| 6,042,063 | A | 3/2000 | Kerr et al. |
| 6,089,514 | A | 7/2000 | Huang et al. |
| 6,155,521 | A | 12/2000 | O'hanlon |
| 6,267,334 | B1 | 7/2001 | Siu |
| 6,543,638 | B2 | 4/2003 | Wile |
| 6,726,156 | B1 | 4/2004 | Scola |
| 7,530,537 | B2 | 5/2009 | Kandah |
| 7,677,507 | B1 | 3/2010 | Rothbauer et al. |
| 7,850,018 | B2 | 12/2010 | Galle |
| 8,857,347 | B1 | 10/2014 | Liu et al. |
| 2007/0228678 | A1 | 10/2007 | Solomon et al. |
| 2010/0314507 | A1 | 12/2010 | Laitila et al. |
| 2011/0266092 | A1 | 11/2011 | Marquis et al. |
| 2012/0111810 | A1 | 5/2012 | Tan |
| 2015/0083677 | A1 | 3/2015 | Tan et al. |
| 2015/0103539 | A1 | 4/2015 | Lee |
| 2015/0226451 | A1 | 8/2015 | Crowley |
| 2017/0172322 | A1 | 6/2017 | Bacallao |

FOREIGN PATENT DOCUMENTS

| | | | |
|---|---|---|---|
| CN | 205402170 | U | 7/2016 |
| GB | 2200035 | A | 7/1988 |
| JP | 2015217972 | A | 12/2015 |
| WO | 2008054720 | A2 | 5/2008 |
| WO | 2015030704 | A2 | 3/2015 |

OTHER PUBLICATIONS

"Lot 2 Royston Plastic Grocery Bag Holder Dispenser Stand Point of Sale Shopping," TeraPeak.com, accessed on Nov. 17, 2016; 3 pages.

"Bag Holders," ULINE.mx, accessed on Nov. 17, 2016; 1 page.

"OEM Express Checkout Counter / Customized Supermarket Cash Register Stands Counters," Guangzhou ECO Commerical Equipment Co., Ltd, SupermarketCheckoutCounters.com, accessed on Nov. 17, 2016; 3 pages.

Notice of Allowance in U.S. Appl. No. 15/381,552, dated Sep. 20, 2017; 8 pages.

Search Report in GB Patent Application No. GB1712474.4, dated Feb. 1, 2018; 3 pages.

"Econoco sh/5h—5 Hook Faceour, Pack of 24, Econoco," Google.com/shopping, accessed on Oct. 16, 2015.

Search Report in UK Patent Application No. 1621383.7, dated Mar. 20, 2017; 5 pages.

Non-Final Office Action in U.S. Appl. No. 15/381,552, dated Jun. 16, 2017; 9 pages.

"Deck Joist Tie 14 Ga.," HomeDepot.ca, accessed on Apr. 27, 2017.

"Metal Building Materials C Z Purlin Wall Girt Manufacture," ADTOMall.com, accessed on Apr. 27, 2017.

"Tripp Lite 4U Hinged Wall Mount Patch Panel Bracket," Amazon.com, accessed on Apr. 27, 2017.

5-Opening 4 in. × 6 in. Pallet Picture Frame, Pannacle, HomeDepot.com, accessed on Apr. 27, 2017.

Non-Final Office Action for U.S. Appl. No. 15/798,642, dated Mar. 2, 2018.

BAGGING STATION SUPPORT FRAME AND METHOD OF FORMING THE SAME

CROSS REFERENCE TO RELATED APPLICATION

This application is a continuation-in part of U.S. patent application Ser. No. 15/381,552, filed Dec. 16, 2016 to Applicant Wal-Mart Stores Inc., and entitled "Bagging Station Support Frame and Method of Forming the Same", which claims priority to U.S. provisional patent application Ser. No. 62/270,881, filed Dec. 22, 2015 to Applicant Wal-Mart Stores Inc., and entitled "Bagging Station Support Frame and Method of Forming the Same", and U.S. provisional patent application Ser. No. 62/375,691, filed Aug. 16, 2016 to Applicant Wal-Mart Stores Inc., and entitled "Bagging Station Support Frame and Method of Forming the Same", all of which are incorporated entirely herein by reference.

BACKGROUND OF THE INVENTION

Technical Field

This invention relates to retail store fixtures, and specifically to a support frame to hold a bagging station in a retail store.

State of the Art

A bagging station is a device that holds a stack of shopping bags, usually plastic shopping bags, and dispenses the shopping bags so that the shopping bags can be filled with products a customer purchases. Bagging stations are often placed at checkout counters so that baggers can place products that have gone through checkout in a bag from the bagging station. There are usually mounting structures for the bagging stations at the checkout counters because checkout counters are where payment and bagging of purchased items are traditionally performed. With the advent of electronic purchasing and self-checkout by a customer, products can now be loaded into a shopping bag anywhere in a store. Customers can purchase their products electronically as they shop, and can load the products into a bag on their own. Thus, there is a need for bagging stations in locations in retail stores besides at the checkout counter.

Accordingly, what is needed is a fixture to hold a bagging station, the fixture configured such that it can be easily mounted at various places throughout a retail store, not just at checkout registers, and the bagging station can be easily mounted to the fixture.

DETAILED DESCRIPTION OF EMBODIMENTS OF THE INVENTION

Figure 1:
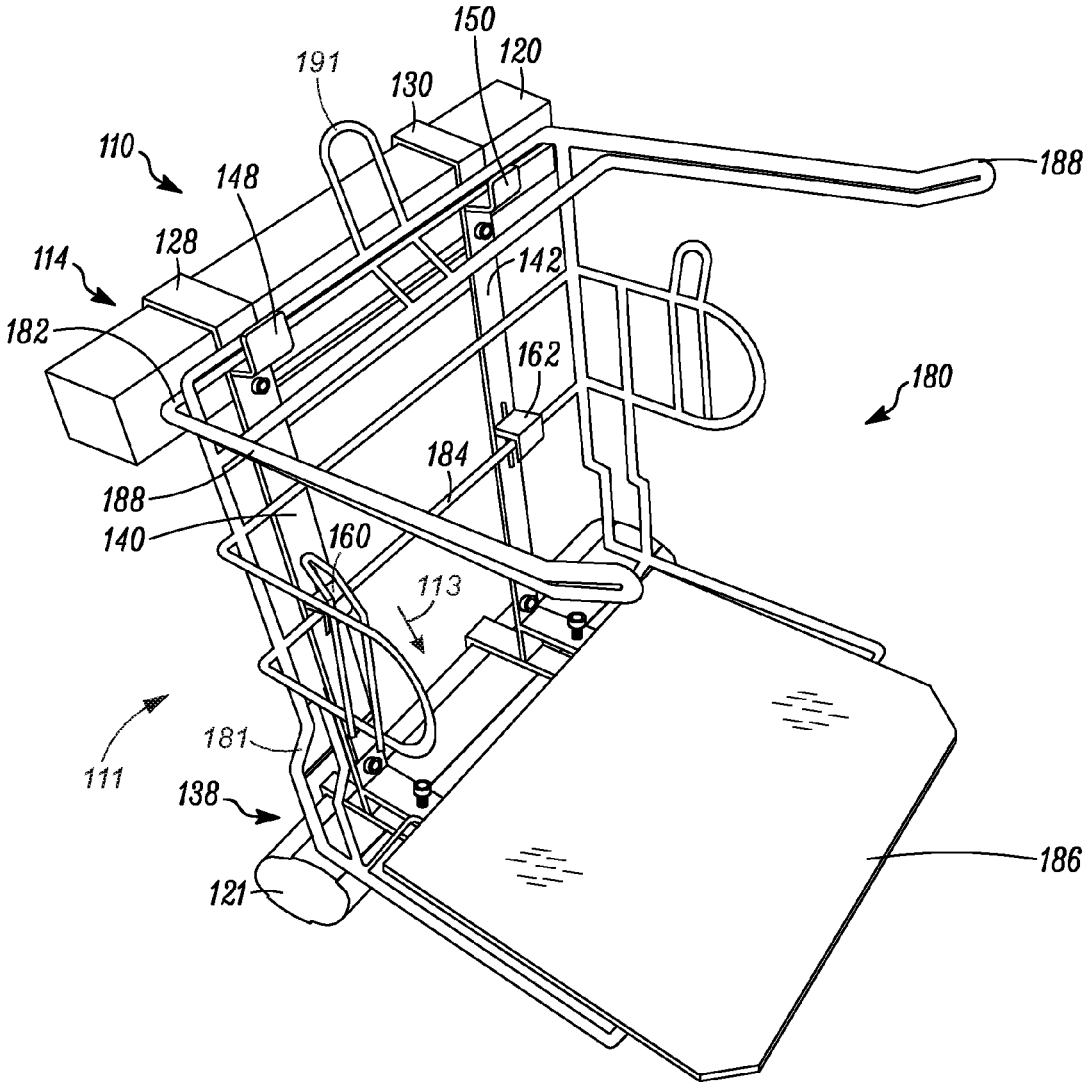
FIG. 1 shows a perspective view of a bagging station mounted to a bagging station support frame, with the bagging station support frame mounted to a first and a second rail.

As discussed above, embodiments of the present invention relate to retail store fixtures, and specifically to a support frame to hold a bagging station in a retail store. Disclosed herein is a bagging station support frame that includes a top assembly and a bottom assembly. The top assembly holds the bagging station. The bottom assembly mounts the top assembly and the bagging station to a rail. A bagging station holds a plurality of shopping bags ready to receive products. The top assembly includes a back structure that couples to the bagging station, and a rail coupler. The rail coupler couples the top assembly to a first rail. The bottom assembly is coupled to the top assembly, and includes a first and a second foot. The first and the second foot set on a second rail. The bagging station support frame can be coupled to rails anywhere in a retail store. A bagging station is mounted to the bagging station support frame so that it will be available for customers to bag their purchases wherever the bagging station support frame with bagging station is mounted. By mounting bagging station support frames with bagging stations throughout the retail store, customers can easily bag their purchases as they shop, without having to go to a checkout counter to obtain shopping bags.

A bagging station is a fixture that holds a stack of shopping bags, usually plastic shopping bags, and dispenses these shopping bags as they are being filled with products a customer purchases. Bagging stations are placed at checkout counters so that baggers can place products that have gone through checkout into a bag at the bagging station. There are mounting structures for bagging stations at checkout counters because, until recently, a customer purchased their products at checkout counters, and those products were also bagged at the checkout counters. With the advent of electronic purchasing and self-checkout by a customer, products can now be loaded into bags anywhere in a store. Customers can purchase their products electronically as they shop, and can load the products into a bag on their own. Thus, there is a need for shopping bags and bagging stations at locations in retail stores besides the checkout counter. The disclosed bagging station support frame is easily mounted to rails found throughout a retail store. The bagging station support frame holds the bagging station with shopping bags, making the bagging stations available to customers at various places in the retail store. The customer can use the bagging stations located throughout the retail store to bag their products as they shop.

The disclosed bagging station support frame includes a means to hold a bagging station, and a means to couple the means to hold the bagging station to a rail. A "rail" as used herein, is any rigid fixture, such as a bar or rod or other elongate structure found in a retail store, with a length longer than its width or diameter, that the means to hold the bagging station can couple to. With the bagging station support frame able to couple to rails throughout a retail store, a bagging station mounted to the bagging station support frame is available to shoppers to use while shopping. In some embodiments, the bagging station support frame is coupled to more than one rail. In some embodiments, the bagging station support frame includes a means to couple the means to hold the bagging station to a first rail, and a means to couple the means to hold the bagging station to a second rail.

FIG. 1 shows a bagging station support frame 110, with a bagging station 180 coupled to bagging station support frame 110.

Bagging station 180 is used to hold and dispense shopping bags in a retail store. Bagging station 180 includes a frame 181 formed of rigid rods in this embodiment. Frame 181 includes a bagging station top rail 182 and a shopping bag hook 191 coupled to frame 181. A pair of bagging station arms 188 are coupled to either end of bagging station top rail 182. Frame 181 also includes a bagging station middle rail 184 and a bottom plate 186. Bagging station top rail 182 and bagging station middle rail 184 couple to bagging station support frame 110 to couple bagging station 180 to bagging station support frame 110. Bottom plate 186 supports a shopping bag and items in the shopping bag as it is being filled. A stack of plastic shopping bags is hung on shopping bag hook 191, with the handles hung on each of bagging station arms 188. Each bag is pulled open to fill it, with items placed in the bags and the bag being supported by bagging station bottom plate 186. Once a shopping bag is filled with items, the bag with the items is removed from bagging station 180 and the next bag is opened and filled. It is to be understood that bagging station 180 is one example of a bagging station. Bagging station support frame 110 can be used to hold many different types of bagging stations.

The job of filling shopping bags with purchased items has historically been performed by a store employee or the customer at a checkout register. Now that electronic checkout is becoming a popular option, a customer can now purchase and bag products themselves as they shop. Bagging station support frame 110 makes it possible to mount bagging station 180 wherever a rail can be found in the retail store. Rails are common fixtures in retail stores, used to hold shelves, signs, and other store fixtures. FIG. 1 shows bagging station support frame 110 mounted to a square first rail 120 and an oval shaped second rail 121. Bagging station support frame 110 can be mounted to rails of many sizes and shapes, as will be explained herein. Mounting bagging station support frame 110 to a rail at a location in the retail store convenient for customers, and then mounting a bagging station 180 to bagging station support frame 110, provides a way for customers to bag their purchases as they shop.

Figure 2:
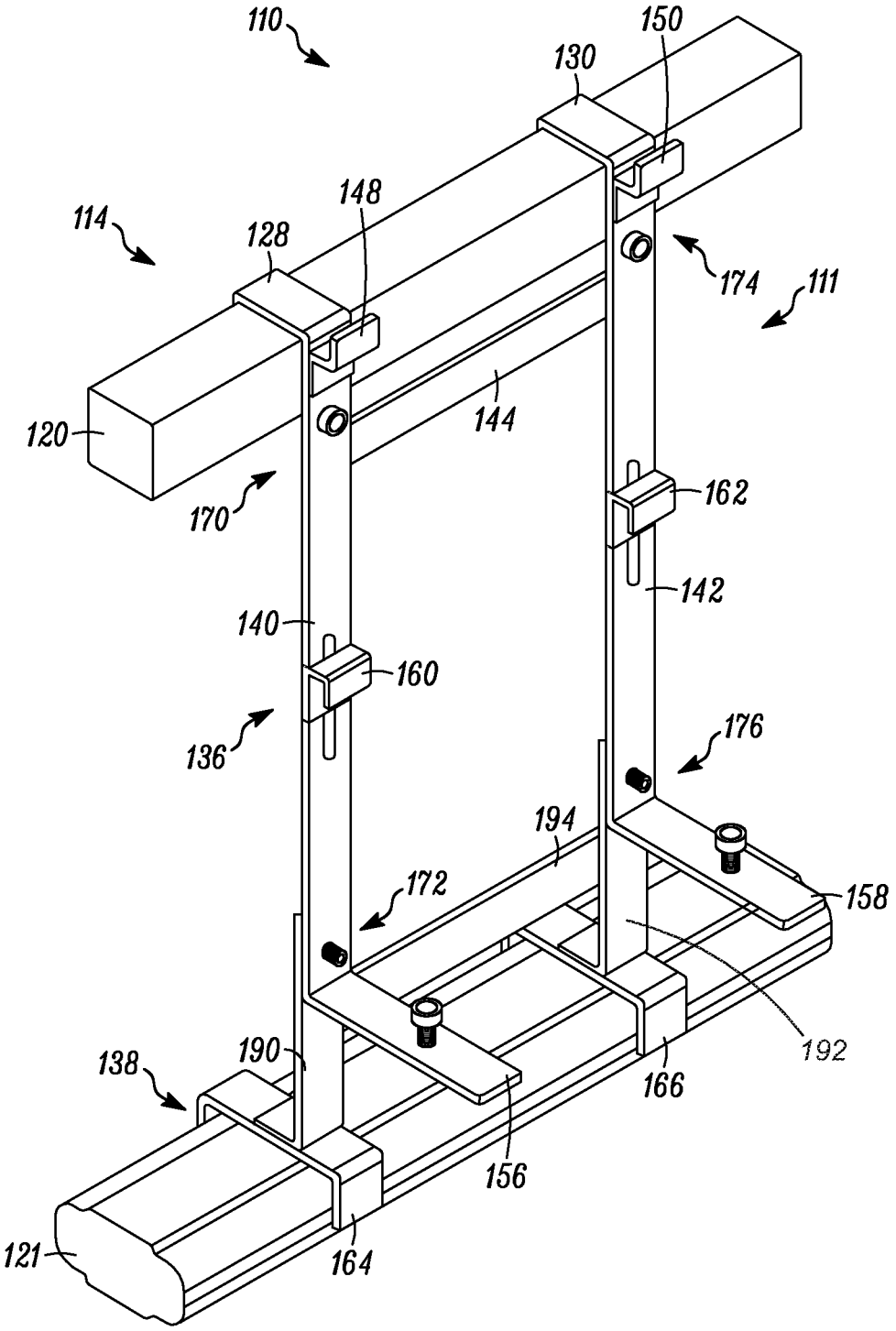
FIG. 2 shows a perspective view of a bagging station support frame mounted to a first and a second rail.
Figure 3:
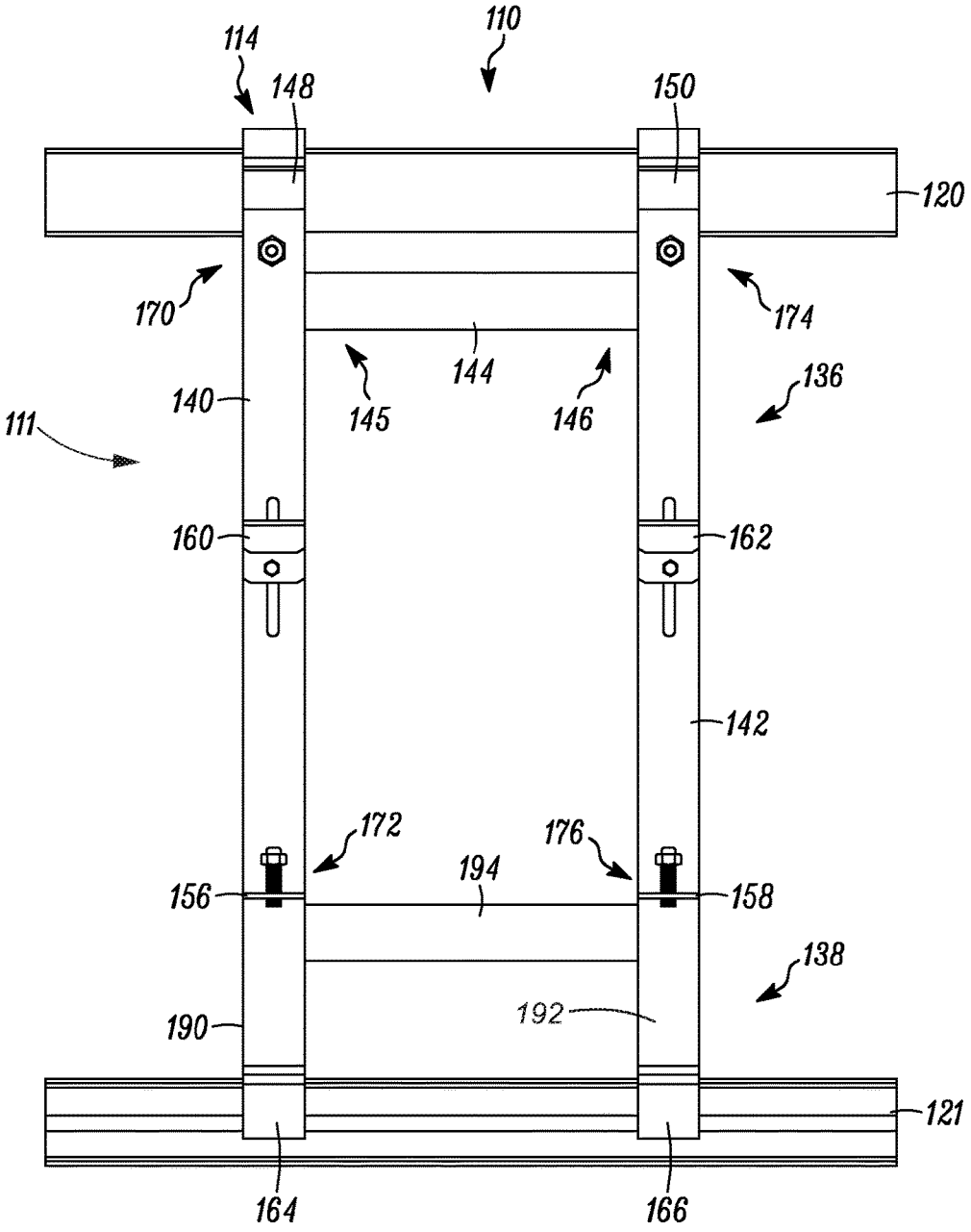
FIG. 3 shows a front view of the bagging station support frame of FIG. 2.
Figure 4:
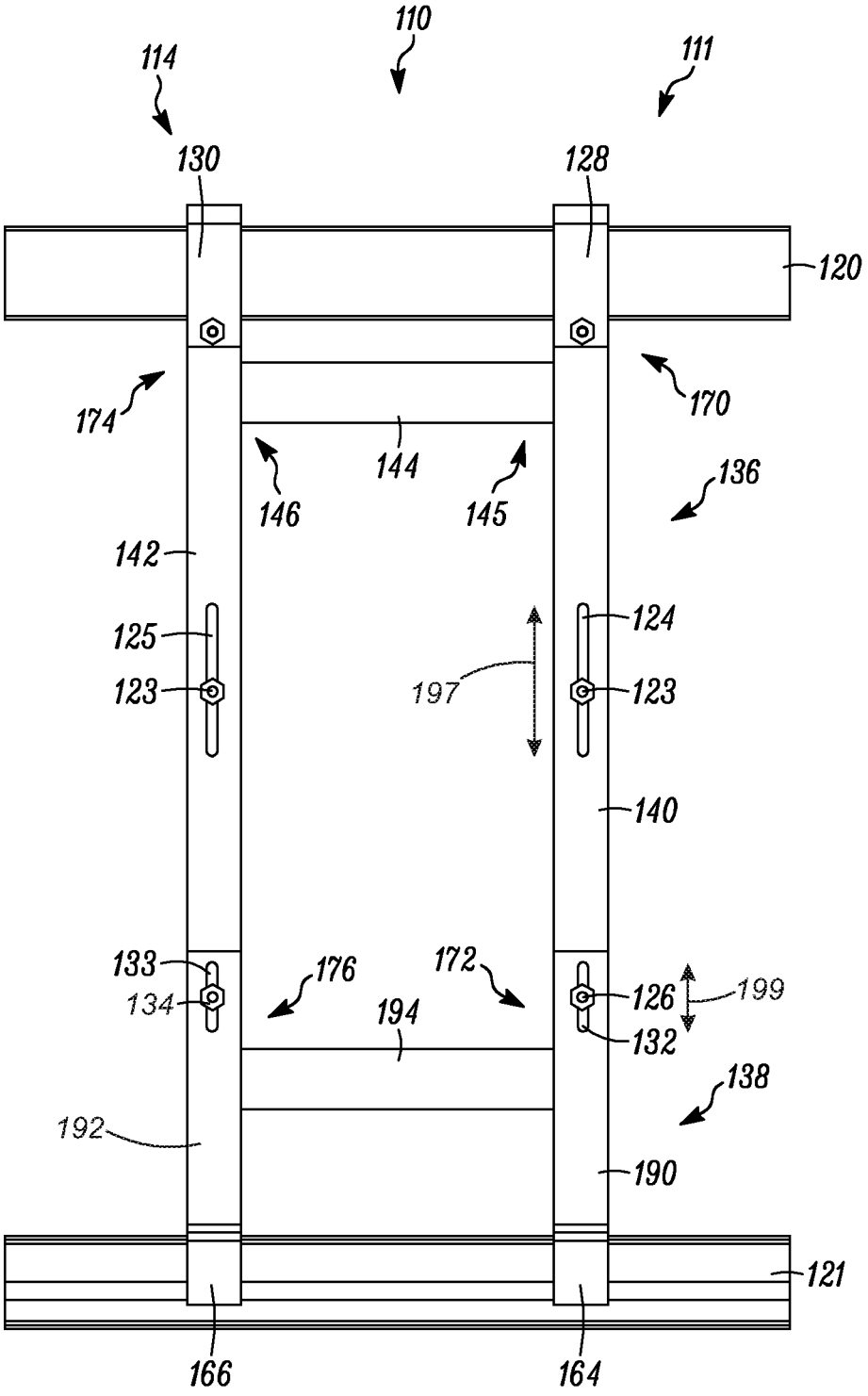
FIG. 4 shows a rear view of the bagging station support frame of FIG. 2.
Figure 5:
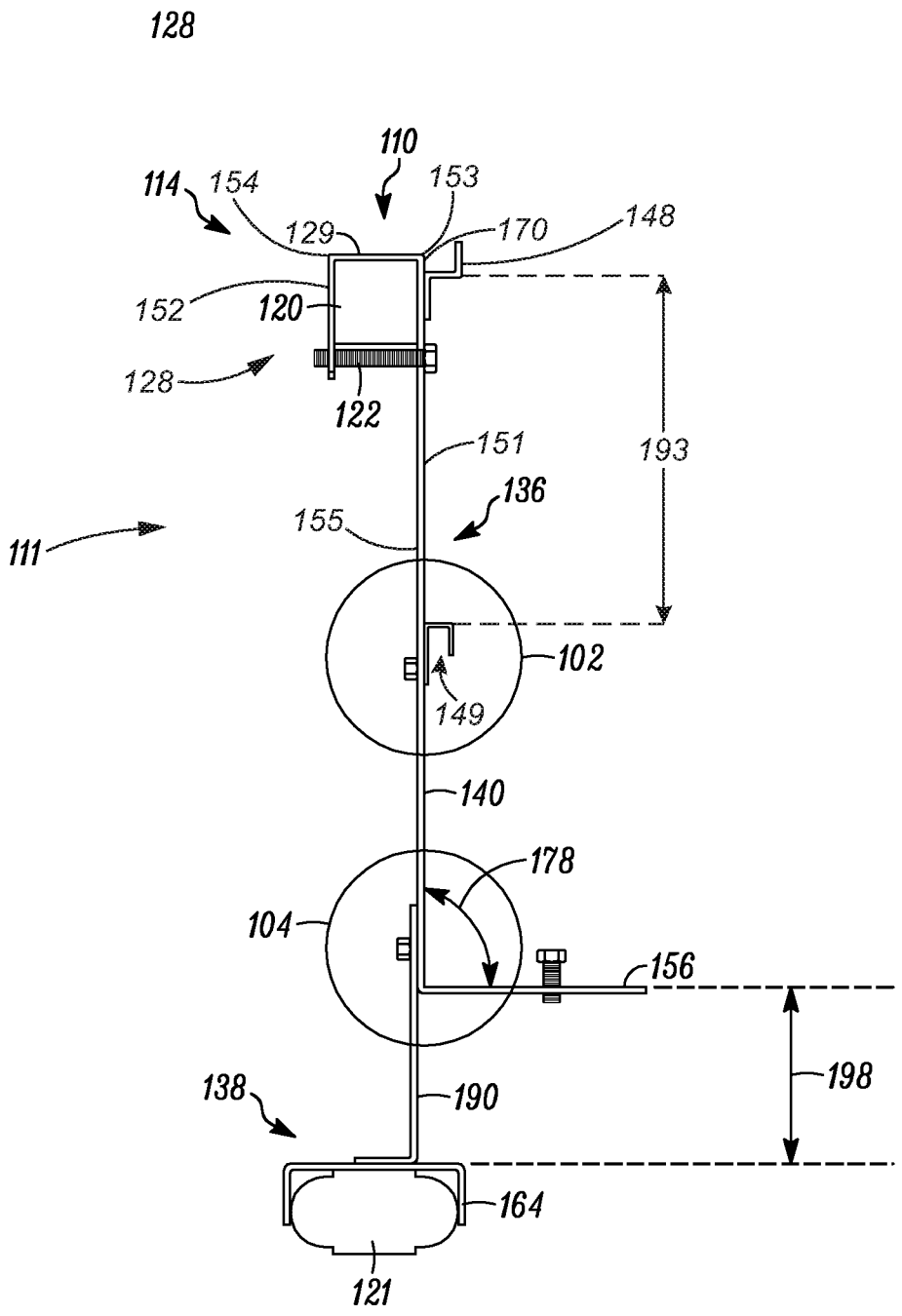
FIG. 5 shows a side view of the bagging station support frame of FIG. 2.
Figure 6:
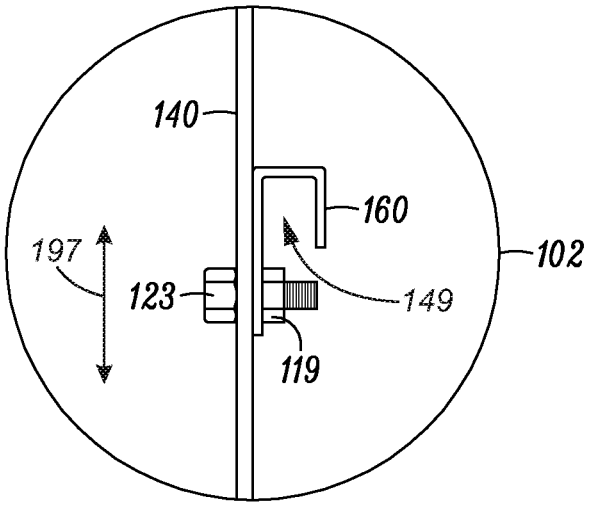
FIG. 6 shows a side view close-up of a bagging station middle rail holder of a bagging station back structure coupled to a support bar of a bagging station back structure.
Figure 7:
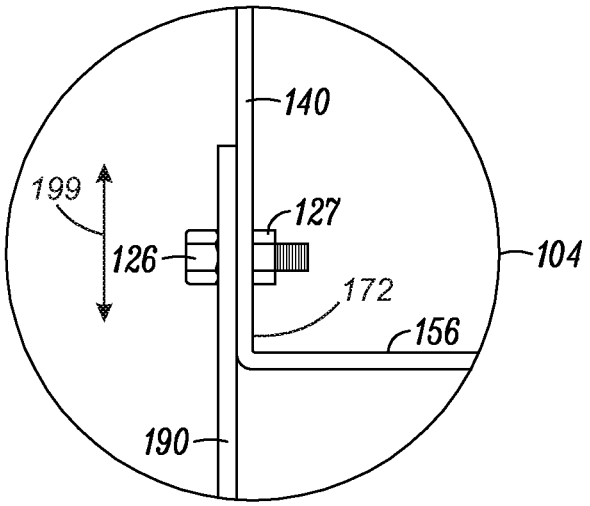
FIG. 7 shows a side view close-up of the coupling between a bottom plate support bar and a support bar of a bagging station back structure.
Figure 8:
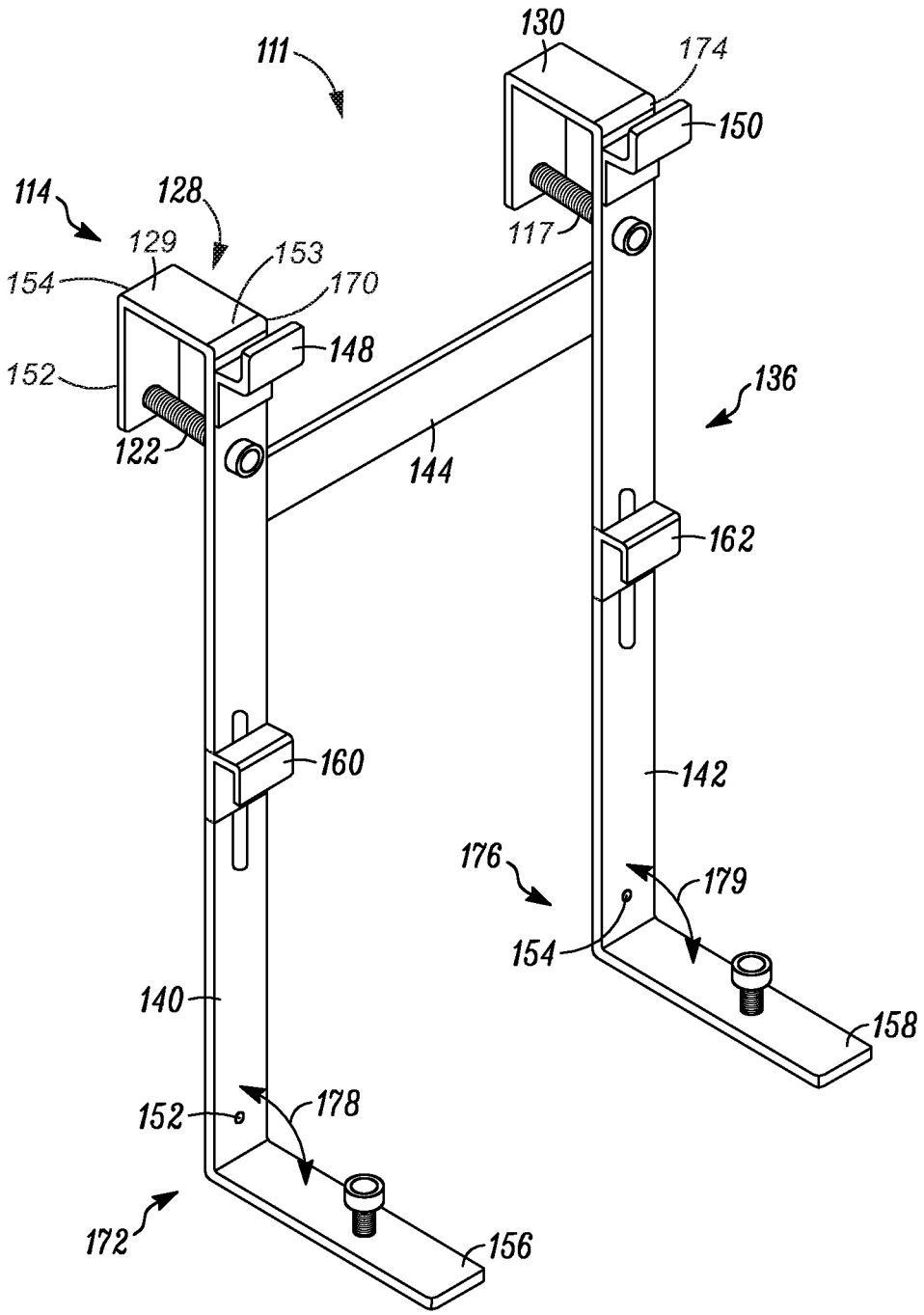
FIG. 8 shows a perspective view of a top assembly of a bagging station support frame.
Figure 9:
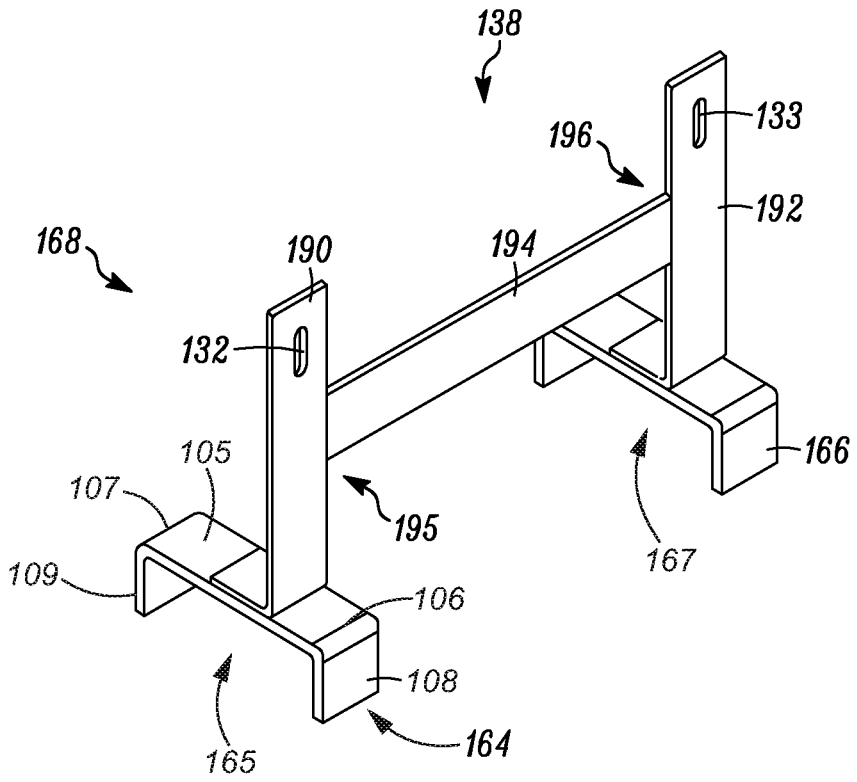
FIG. 9 shows a perspective view of a bottom assembly of a bagging station support frame.

FIG. 2 through FIG. 9 show details of bagging station support frame 110. FIG. 2 shows a perspective view of bagging station support frame 110 coupled to first rail 120 and second rail 121. FIG. 3 shows a front view of bagging station support frame 110 coupled to first rail 120 and second rail 121. FIG. 4 shows a rear view of bagging station support frame 110 coupled to first rail 120 and second rail 121. FIG. 5 shows a side view of bagging station support frame 110 coupled to first rail 120 and second rail 121. FIG. 6 shows an exploded side view of middle rail holder 160 coupled to a support bar 140 of bagging station support frame 110. FIG. 7 shows an exploded side view of a first support bar second end 172 of first support bar 140, with a first bottom plate support bar 156 and a first stem bar 190 coupled to first support bar second end 172. FIG. 8 shows a perspective view of a top assembly 111 of bagging station support frame 110. FIG. 9 shows a perspective view of a bottom assembly 138 of bagging station support frame 110. Bagging station support frame 110 is formed of metal bars in the embodiments shown in the figures, but this is not meant to be limiting. Bagging station support frame 110 can be made of any material suitable for holding bagging station 180, including plastic, wood, metal, or synthetic materials.

Bagging station support frame 110 includes a top assembly 111 and a bottom assembly 138. Bottom assembly 138 is coupled to top assembly 111. In the embodiments shown in the figures, bottom assembly 138 is adjustably coupled to top assembly 111. Top assembly 111 is shown in FIG. 8, and bottom assembly 138 is shown in FIG. 9. FIG. 2 through FIG. 5 show bottom assembly 138 coupled to top assembly 111 to form bagging station support frame 110.

Top assembly 111 is a means to hold a bagging station. Top assembly 111 holds bagging station 180 as shown in FIG. 1. Top assembly 111 includes a back structure 136 and a support frame coupler 114. Back structure 136 holds bagging station 180, and support frame coupler 114 couples top assembly 111 to a rail 120 in the embodiments shown. Support frame coupler 114 is coupled to back structure 136. Support frame coupler 114 is a means to couple bagging station support frame 110 to a rail. The means to couple bagging station support frame 110 to a rail, shown as support frame coupler 114 in the figures, can take many different forms. It is to be understood that the means to couple bagging station support frame 110 to a rail is not limited to the forms shown and described. In some embodiments, support frame coupler 114 couples bagging station support frame 110 to a fixture other than a rail.

Top assembly 111 includes back structure 136. Back structure 136 provides the basic structural support and interconnect for the elements of bagging station support frame 110. Back structure 136 can take many different forms. Back structure 136 is a means to hold bagging station 180, as shown in FIG. 1. Back structure 136 is coupled to a rail with support frame coupler 114, as shown in FIG. 2 through FIG. 5. Back structure 136 includes a first support bar 140 and a second support bar 142 as shown in FIG. 2 through FIG. 5 and FIG. 8. First and second support bars 140 and 142 are coupled together with a coupler bar 144. First and second support bars 140 and 142, and coupler bar 144, form the skeletal frame of back structure 136. Back structure 136 also includes a first bagging station top rail holder 148 and a second bagging station top rail holder 150. First and second bagging station top rail holders 148 and 150 hold bagging station top rail 182 to couple bagging station 180 to bagging station support frame 110. Back structure 136 also includes a first bottom plate support bar 156 and a second bottom plate support bar 158. Bagging station 180 sets on first and second bottom plate support bars 156 and 158, as shown in FIG. 1. Back structure 136 also includes a first bagging station middle rail holder 160 and a second bagging station middle rail holder 162. First and second bagging station middle rail holders 160 and 162 hold bagging station middle rail 184 to couple bagging station 180 to bagging station support frame 110, as shown in FIG. 1.

First support bar 140 is an elongate bar of rigid material with a first support bar first end 170 and a first support bar second end 172 opposing first support bar first end 170. First support bar first end 170 is coupled to a support frame coupler hook 128 of support frame coupler 114. Second support bar 142 is an elongate bar of rigid material with a second support bar first end 174 and a second support bar second end 176 opposing second support bar first end 174. Second support bar first end 174 is coupled to a support frame coupler hook 130 of support frame coupler 114. First support bar 140 and second support bar 142 are each straight elongate bars of metal in this embodiment, but this is not meant to be limiting. First support bar 140 and second support bar 142 can be elongate members of many types of rigid material.

Coupler bar 144 couples first support bar 140 to second support bar 142. A coupler bar first end 145 (FIG. 3 and FIG. 4) is coupled to first support bar 140. A coupler bar second end 146 is coupled to second support bar 142. Coupler bar 144 extends between first support bar 140 and second support bar 142, and couples first support bar 140 and second support bar 142, as shown in the figures.

Bottom plate support bars 156 and 158 are a means to support bagging station 180 by supporting bagging station bottom plate 186 (FIG. 1). Bagging station 180 sets on first and second bottom plate support bars 156 and 158. First and second bottom plate support bars 156 and 158 provide support for bottom plate 186 from underneath bottom plate 186. Means to support bottom plate 186 is in the form of two support bars in this embodiment, but this is not meant to be limiting. Means to support bottom plate 186 can be a single bar, a plate, a plurality of rails, rods, or bars, or any structure which supports bottom plate 186.

First bottom plate support bar 156 is a straight elongate bar of rigid material in this embodiment. First bottom plate support bar 156 is straight so that bottom plate 186 sets flat on first bottom plate support bar 156. First bottom plate support bar 156 extends from first support bar second end 172, forming an angle 178 between first support bar 140 and first bottom plate support bar 156. In this embodiment, first bottom plate support bar 156 extends from first support bar second end 172 in a direction perpendicular to first support bar 140, so angle 178 is approximately 90 degrees in this embodiment, as can best be seen in FIG. 5 and FIG. 8. An angle 178 of approximately 90 degrees supports bottom plate 186 being horizontally oriented. In some embodiments, angle 178 has other values, to provide for other orientations of bottom plate 186 and other mounting configurations. First bottom plate support bar 156 extends from first support bar 140 in a direction away from a first support bar rear surface 155 (FIG. 5), meaning first bottom plate support bar 156 extends frontwards from first support bar 140, towards bagging station 180 so that first bottom plate support bar 156 can support bagging station 180 when bagging station 180 is coupled to bagging station support frame 110.

Second bottom plate support bar 158 is a straight elongate bar of rigid material in this embodiment. Second bottom plate support bar 158 is straight so that bottom plate 186 sets flat on second bottom plate support bar 158. Second bottom plate support bar 158 extends from second support bar second end 176, forming an angle 179 between second support bar 142 and second bottom plate support bar 158. In this embodiment, second bottom plate support bar 158 extends from second support bar second end 172 in a direction perpendicular to second support bar 142, so angle 179 is approximately 90 degrees in this embodiment, as can best be seen in FIG. 8. An angle 179 of approximately 90 degrees supports bottom plate 186 being horizontally oriented. In some embodiments, angle 179 has other values, to provide for other orientations of bottom plate 186. Second bottom plate support bar 158 extends frontwards from second support bar 142, in a direction away from first support bar rear surface 155 and towards bagging station 180 when bagging station 180 is mounted to bagging station support frame 110.

Back structure 136 also includes a means to hold a top rail of bagging station 180, which in this embodiment is a first and a second bagging station top rail holder 148 and 150, as can best be seen in FIG. 1, FIG. 2, and FIG. 8. First and second bagging station top rail holders 148 and 150 hold bagging station top rail 182, as shown in FIG. 1. First and second bagging station top rail holders 148 and 150 extend from a first support rail 140 front surface 151 to each form a U-shaped structure that holds bagging station top rail 182. The openings of first and second bagging station top rail holders 148 and 150 extend upwards away from bottom assembly 138. Bagging station top rail 182 slides into first and second bagging station top rail holders 148 and 150, which helps couple bagging station 180 to bagging station support frame 110. It is to be understood that the means to hold a top rail of bagging station 180 can take many different forms. Any form that holds bagging station top rail 182 can be used.

First bagging station top rail holder 148 is coupled to first support bar first end 170, see FIG. 2 and FIG. 8, for example. Second bagging station top rail holder 150 is coupled to second support bar first end 174, as shown in FIG. 2 and FIG. 8, for example.

Back structure 136 also includes a means to hold bagging station middle rail 184. In the embodiment shown in the figures, means to hold a bagging station middle rail 184 takes the form of first and second bagging station middle rail holders 160 and 162, as shown in FIG. 1. First and second bagging station middle rail holders 160 and 162 capture and hold bagging station middle rail 184, as shown in FIG. 1. First and second bagging station middle rail holders 160 and 162 are adjustably coupled to first and second support bars 140 and 142 so that a distance 193 (FIG. 5) between first and second bagging station middle rail holders 160 and 162 and first and second bagging station top rail holders 148 and 150 is adjustable. First and second bagging station middle rail holders 160 and 162 are U-shaped brackets oriented downwards, with their openings facing bottom assembly 138 and first and second foot 164 and 166. First and second bagging station middle rail holders 160 and 162 extend around bagging station middle rail 184 and apply a downward pressure in a direction 113 (FIG. 1) on bagging station middle rail 184. First and second bagging station middle rail holders 160 and 162 are applying pressure on bagging station middle rail 184 in direction 113 away from bagging station top rail 182. First and second bagging station middle rail holders 160 and 162 applying pressure on bagging station middle rail 184 in direction 113 away from bagging station top rail 182 helps bagging station support frame 110 securely hold bagging station 180.

First bagging station middle rail holder 160 is adjustably coupled to first support bar 140 between first support bar first end 170 and first support bar second end 172 (and first bottom plate support bar 156 coupled to first support bar second end 172). First bagging station middle rail holder 160 is a U-shaped bracket with an opening 149 facing towards bottom assembly 138 (FIG. 5 and FIG. 6). First bagging station middle rail holder 160 is adjustably coupled to first support bar 140 using a first support bar slot 124 in first support bar 140, see FIG. 4 and FIG. 6. A bolt 123 is extended through a hole in first bagging station middle rail holder 160 and first support bar slot 124 of first support bar 140. Bolt 123 and first bagging station middle rail holder 160 can slide up and down first support bar slot 124 in a direction 197 to position first bagging station middle rail holder 160 to hold bagging station middle rail 184. Once first bagging station middle rail holder 160 is in a position along first support bar slot 124 to hold bagging station middle rail 184, a nut 119 is tightened on bolt 123, coupling first bagging station middle rail holder 160 and bolt 123 to first support bar 140. First support bar slot 124 allows first bagging station middle rail holder 160 to slide up and down first support bar 140 so that first bagging station middle rail holder 160 can apply pressure in direction 113 on bagging station middle rail 184.

Second bagging station middle rail holder 162 is adjustably coupled to second support bar 142 between second support bar first end 174 and second support bar second end 176 (and second bottom plate support bar 158). Second bagging station middle rail holder 162 is a U-shaped bracket with an opening facing towards bottom assembly 138. Second bagging station middle rail holder 162 is adjustably coupled to second support bar 142 using a second support bar slot 125 in second support bar 142, see FIG. 4. A bolt 123 is extended through a hole in second bagging station middle rail holder 162 and second support bar slot 125 of second support bar 142. Bolt 123 and second bagging station middle rail holder 162 can slide up and down slot 125 to position second bagging station middle rail holder 162 to hold rail 184. Once second bagging station middle rail holder 162 is in a position along second support bar slot 125 to hold rail 184, a nut is tightened on bolt 123, coupling second bagging station middle rail holder 162 and bolt 123 to first support bar 142. Second support bar slot 125 allows first bagging station middle rail holder 160 to slide up and down second support bar 142 so that second bagging station middle rail holder 162 can apply pressure in direction 113 on bagging station middle rail 184.

In the embodiment shown in the figures, bagging station 180 is coupled to bagging station support frame 110 using first and second bagging station top rail holders 148 and 150, and first and second bagging station middle rail holders 160 and 162, but this is not meant to be limiting. In some embodiments, bagging station 180 is welded to bagging station top assembly 111 of bagging station support frame 110 so that bagging station support frame top assembly 111 and bagging station 180 are one piece.

Support frame coupler 114 couples bagging station support frame 110 to a rail 120 in the embodiments shown in the figures. Support frame coupler 114 couples bagging station support frame 110 to rail 120 by coupling top assembly 111 to rail 120. In the embodiment of bagging station support frame 110 shown in the figures, support frame coupler 114 includes a first support frame coupler hook 128 and a second support frame coupler hook 130, as can best be seen in FIG. 1, FIG. 2, and FIG. 8. Support frame coupler 114, which includes first support frame coupler hook 128 and second support frame coupler hook 130, couples top assembly 111 to rail 120, as shown in FIG. 1. In some installations of bagging station support frame 110, first support frame coupler hook 128 couples to a first rail, and second support frame coupler hook 130 couples to a second rail. First support frame coupler hook 128 is coupled to first support bar first end 170. Second support frame coupler hook 130 is coupled to second support bar first end 174.

First support frame coupler hook 128 and second support frame coupler hook 130 are each square support frame coupler hooks 128 and 130, but this is not meant to be limiting. In some embodiments, first support frame coupler hook 128 and second support frame coupler hook 130 are shapes other than square. First support frame coupler hook 128 includes a bolt 122, and second support frame coupler hook 130 include a bolt 117, best seen in FIG. 5 and FIG. 8, that captures rail 120 in first and second support frame coupler hooks 128 and 130. First support frame coupler hook 128 slides over square rail 120, and square rail 120 is captured in first support frame coupler hook 128 by bolt 122, as shown in FIG. 5. First support frame coupler hook 128 includes an extension bar 129 and a hook bar 152, as shown in FIG. 5 and FIG. 8. Extension bar 129 is an elongate bar of rigid material with an extension bar first end 153 and an extension bar second end 154 opposing extension bar first end 153. Extension bar first end 153 is coupled to first support bar first end 170. Extension bar 129 extends perpendicular to first support bar 140 in a rearward direction, in other words in a direction away from a front surface 151 of first support bar 140. Extension bar 129 extends rearward from first support bar 140, and first bottom plate support bar 156 extends frontwards from first support bar 140. Hook bar 152 is an elongate bar extending perpendicular to extension bar 129 in a direction towards bottom assembly 138. Hook bar 152 is coupled to extension bar second end 154. Hook bar 152 extends perpendicular to extension bar 129 from extension bar second end 154. Bolt 122 extends through hook bar 152 and first support bar 140 to capture rail 120 in first support frame coupler hook 128. Bolt 122 captures rail 120 in first support frame coupler hook 128 in response to first support frame coupler hook 128 extending around rail 120, and bolt 122 extending through hook bar 152 and first support bar 140. In this embodiment, second support frame coupler hook 130 and bolt 117 are a mirror image of first support frame coupler hook 128, but this is not meant to be limiting. In some embodiments, first and second support frame coupler hooks 128 and 130 are different from each other in shape or size, for example, or have other characteristics, in order to accommodate a specific rail configuration.

In some embodiments, support frame coupler 114 includes only one support frame coupler hook. In some embodiments, support frame coupler 114 includes more than two support frame coupler hooks.

Bottom assembly 138 is adjustably coupled to top assembly 111. Bottom assembly 138 is adjustably coupled to top assembly 111 using first and second stem bar slots 132 and 133 in bottom assembly 138 (FIG. 4 and FIG. 9), holes 152 and 154 in top assembly 111 (FIG. 8), and bolts 126 and 134 (FIG. 4 and FIG. 7). Bolt 126 extends through first stem bar slot 132 in bottom assembly 138, and hole 152 in top assembly 111 to adjustably couple a first stem bar 190 to first support bar second end 172. Hole 152 is in first support bar second end 172. Stem bar slot 132 allows bolt 126 to slide along stem bar slot 132, which adjusts a distance 198 between a first foot 164 of bottom assembly 138 and first bottom plate support bar 156, as shown in FIG. 5. Distance 198 is adjusted by sliding bolt 126 along first stem bar slot 132. Adjusting distance 198 allows bagging station support frame 110 to fit different configurations of rails, specifically different distances between first rail 120 and second rail 121. Once distance 198 is adjusted as needed, a nut 127 (FIG. 7) is tightened on bolt 126 to prevent further movement of bolt 126 along stem bar slot 132, and to couple bottom assembly 138 to top assembly 111.

Similarly, a bolt 134 extends through second stem bar slot 133 in a second stem bar 192 of bottom assembly 138, and hole 154 in top assembly 111. Hole 154 is through second support bar second end 176. Second stem bar slot 133 allows bolt 134 to slide along second stem bar slot 133, which adjusts a distance between a second foot 166 of bottom assembly 138 and second bottom plate bar 158. The distance is adjusted by sliding bolt 134 along second stem bar slot 133. Once the distance is adjusted as needed, a nut 127 is tightened on bolt 134 to prevent further movement of bolt 134 along slot 133, and to couple bottom assembly 138 to top assembly 111.

Bottom assembly 138 couples bagging station support frame 110 to second rail 121, as shown in FIG. 1 through FIG. 5. Bottom assembly 138 includes first foot 164 and second foot 166. First and second foot 164 and 166 are C-shaped in this embodiment, and partially encircle second rail 121 as shown in the figures. First and second foot 164 and 166 are C-shaped with their openings 165 and 167 facing away from first and second stem bar 190 and 192, as shown in FIG. 9. In some embodiments, first and second foot 164 and 166 are other shapes to accommodate other coupling configurations.

Bottom assembly 138, in the configuration shown in the figures, includes first and second foot 164 and 166 and an H frame 168. Each of first and second foot 164 and 166 are coupled to H frame 168. H frame 168 includes first stem bar 190, second stem bar 192, and a crossbar 194, best seen in FIG. 9. First stem bar 190 is an elongate length of rigid material. First stem bar 190 is adjustably coupled to first support bar second end 172 of first support bar 140, as explained earlier and shown in FIG. 4, FIG. 5, and FIG. 7. Second stem bar 192 is an elongate length of rigid material. Second stem bar 192 is adjustably coupled to second support bar second end 176 of second support bar 142. Crossbar 194 has a crossbar first end 195 coupled to first stem bar 190, and a crossbar second end 196 coupled to second stem bar 192. First foot 164 is coupled to first stem bar 190. First foot 164 is C-shaped and includes a foot extension bar 105 coupled to first stem bar 190. Foot extension bar 105 is perpendicular to first stem bar 190, with first stem bar 190 coupled to foot extension bar 105 approximately in the middle of foot extension bar 105. First foot hook bar 108 is coupled to a foot extension bar first end 106 and extends perpendicular to foot extension bar 105 in a direction away from first stem bar 190. Second foot hook bar 109 is coupled to a foot extension bar second end 107 and extends perpendicular to foot extension bar 105 in a direction away from first stem bar 190. First foot 164 faces downward, meaning opening 165 of first foot 164 faces away from first stem bar 190. Similarly, second foot 166 is C-shaped with an opening 167 facing downward, away from second stem bar 192. First and second foot 164 and 166 are C-shaped so they can partially encircle, and set on, second bar 121. First and second foot 164 and 166 set on second rail 121, and distance 198 is adjusted to firmly press first and second foot 164 and 166 on second rail 121 to couple bagging station support frame 110 to second rail 121. First and second foot 164 and 166 face downward so that they can set on the top of second rail 121 and couple bottom assembly 138 to second rail 121.

Figure 10:
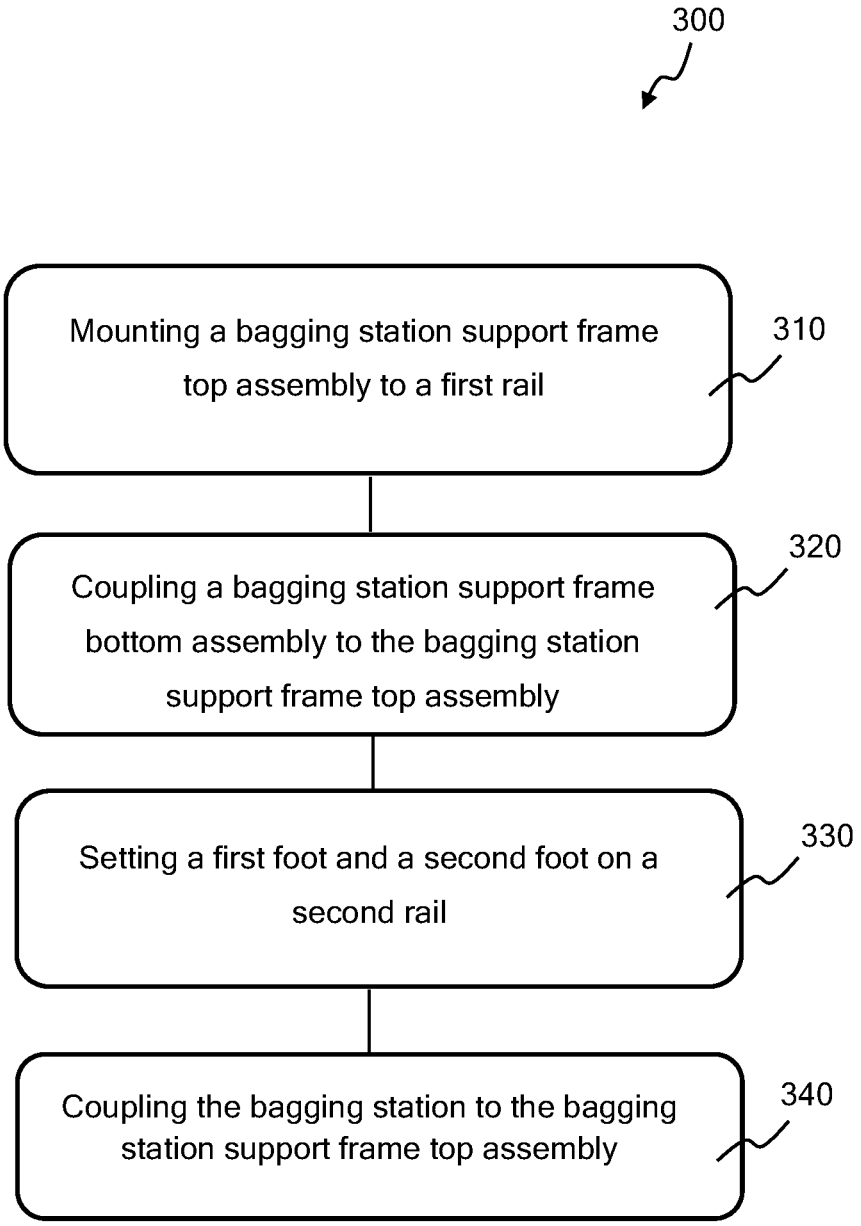
FIG. 10 illustrates a method of mounting a bagging station.

FIG. 10 illustrates a method 300 of mounting a bagging station. Method 300 includes an act 310 of mounting a bagging station support frame top assembly to a first rail. Mounting the bagging station support frame top assembly to the first rail can include mounting a first and a second support frame coupler hook to the first rail.

Method 300 also includes an act 320 of coupling a bagging station support frame bottom assembly to the bagging station support frame top assembly. In some embodiment, act 320 of coupling the bagging station support frame bottom assembly to the bagging station support frame top assembly includes extending a first bolt through a first slot in a first stem bar of the bottom assembly and a first hole in a first support bar second end of the top assembly. In some embodiments, act 320 of coupling the bagging station support frame bottom assembly to the bagging station support frame top assembly includes extending a second bolt through a second slot in a second stem bar of the bottom assembly and a second hole in a second support bar second end of the top assembly. The first bolt adjustably couples the first stem bar to the first support bar second end. The second bolt adjustably couples the second stem bar to the second support bar second end.

Method 300 also includes an act 330 of setting a first foot and a second foot of the bottom assembly on a second rail. In some embodiments, setting the first foot and the second foot on the second rail includes adjusting a distance between the first bottom plate support bar and the first foot by sliding a bolt along a slot in the first stem bar, wherein the bolt extends through the slot and the first support bar to couple the bottom assembly to the top assembly.

Method 300 also includes an act 340 of coupling the bagging station to the bagging station support frame top assembly. In some embodiments, act 340 of coupling the bagging station to the bagging station support frame top assembly includes mounting a bagging station top rail to a first and a second bagging station top rail holder of the bagging station. In some embodiments, act 340 of coupling the bagging station to the bagging station support frame top assembly includes coupling a bagging station middle rail to a first and a second bagging station middle rail holder of the bagging station. In some embodiments, the first and the second bagging station middle rail holders apply pressure on the bagging station middle rail in a direction away from the bagging station top rail. In some embodiments, the bagging station is welded to the bagging station support frame top assembly so that the bagging station and the bagging station support frame top assembly are one unit.

A bagging station support frame has been shown and described, as well as a combination of a bagging station support frame and a bagging station, and a method of mounting a bagging station. The bagging station support frame holds the bagging station. The bagging station support frame can be coupled to at least one rail in various locations throughout a retail store. The bagging station support frame with a bagging station coupled to it provides a fixture for customers and employees of the retail store to obtain shopping bags so they can bag purchases. By using electronic and self-checkout, customers no longer are required to go to a checkout counter to pay for and bag their purchases. Having bagging stations mounted to bagging station support frames at various locations in the retail store will help customers conveniently and easily bag their purchases as they shop.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above. For example, the bagging station support frame shown and describe is formed of multiple separate elements. In some embodiments, a bagging station support frame according to the invention is formed of one integral piece of material, molded or otherwise.

The invention claimed is:

1. A combination bagging station support frame and bagging station for supporting a bag, comprising:

a bagging station having a bagging station top rail, a bagging station middle rail and a bottom plate; and a bagging station support frame comprising:

a top assembly which comprises:

a back structure comprising:

a first support bar, wherein the first support bar is a first straight elongate bar of rigid material having a first support bar first end and a first support bar second end opposing the first support bar first end;

a second support bar, wherein the second support bar is a second straight elongate bar of rigid material having a second support bar first end and a second support bar second end opposing the second support bar first end;

a coupler bar extending between and coupled to both the first and the second support bar;

a first bagging station top rail holder coupled to the first support bar first end;

a second bagging station top rail holder coupled to the second support bar, wherein the first bagging station top rail holder and the second bagging station top rail holder support the bagging station top rail first end, wherein the first and the second bagging station top rail holders hold the bagging station top rail;

a first bottom plate support bar coupled to the first support bar second end, wherein the first bottom plate support bar is a third straight elongate bar of rigid material and wherein the first bottom plate support bar extends from the first support bar second end perpendicular to the first support bar;

a second bottom plate support bar coupled to the second support bar second end, wherein the second bottom plate support bar is a fourth straight elongate bar of rigid material wherein the second bottom plate support bar extends from the second support bar second end perpendicular to the second support bar, and wherein the bottom plate of the bagging station sits on the first and the second bottom plate support bars;

a first bagging station middle rail holder adjustably coupled to the first support bar between the first support bar first end and the first bottom plate support bar; and a second bagging station middle rail holder adjustably coupled to the second support bar between the second support bar first end and the second bottom plate support bar, wherein the first and the second bagging station middle rail holders extend around the bagging station middle rail and apply pressure on the bagging station middle rail in a direction away from the bagging station top rail; and a support frame coupler comprising first and second support frame coupler hooks, wherein the first and second support frame coupler hooks are adapted to mounted on a supporting rail;

and a bottom assembly coupled to the top assembly, wherein the bottom assembly comprises a first foot and a second foot.

2. The combination of claim 1, wherein the bottom assembly comprises:

a first stem bar adjustably coupled to the first support bar second end;

a second stem bar adjustably coupled to the second support bar second end; and a crossbar having a crossbar first end coupled to the first stem bar and a crossbar second end coupled to the second stem bar;

wherein the first foot is coupled to the first stem bar, and wherein the first foot is C-shaped opening away from the first stem bar;

and wherein the second foot is coupled to the second stem bar, and wherein the second foot is C-shaped opening away from the second stem bar.

3. The combination of claim 2, wherein the first stem bar comprises a stem bar slot, wherein a bolt extends through the stem bar slot and the first support bar second end to couple the first stem bar to the first support bar second end, and wherein adjusting a position of the bolt along the stem bar slot adjusts a distance between the first bottom plate support bar and the first foot.

4. The combination of claim 1, wherein the first support frame coupler hook comprises:

an extension bar having an extension bar first end and an extension bar second end opposing the extension bar first end, wherein the extension bar first end is coupled to the first support bar first end, and wherein the extension bar extends perpendicularly from the first support bar in a direction away from a first support bar front surface;

a hook bar coupled to the extension bar second end and extending perpendicularly from the extension bar in a direction towards the bottom assembly; and a bolt, wherein the bolt extends through the hook bar and the first support bar.

5. The combination of claim 1, wherein the first and the second bottom plate support bars extend in a direction away from a first support bar rear surface.

6. The combination of claim 1, wherein the first support bar comprises a first support bar slot, and wherein the first bagging station middle rail holder is adjustably coupled to the first support bar slot and slides along the first support bar slot to adjust a position of the first bagging station middle rail holder.

7. The combination of claim 6, wherein the first bagging station middle rail holder is a U-shaped bracket opening towards the bottom assembly.

* * * * *